US008904839B2

(12) United States Patent
Hoeffgen et al.

(10) Patent No.: US 8,904,839 B2
(45) Date of Patent: Dec. 9, 2014

(54) METHOD OF AND ROLLING MILL FOR MAKING SEAMLESS STEEL PIPE

(75) Inventors: Walter Hoeffgen, Korschenbroich (DE); Norbert Theelen, Erkelenz (DE)

(73) Assignee: SMS Meer GmbH, Moenchengladbach (DE)

( * ) Notice: Subject to any disclaimer, the term of this patent is extended or adjusted under 35 U.S.C. 154(b) by 896 days.

(21) Appl. No.: 12/679,057

(22) PCT Filed: Jul. 14, 2009

(86) PCT No.: PCT/EP2009/005093

§ 371 (c)(1),
(2), (4) Date: Mar. 30, 2010

(87) PCT Pub. No.: WO2010/025790

PCT Pub. Date: Mar. 11, 2010

(65) Prior Publication Data

US 2010/0212387 A1 Aug. 26, 2010

(30) Foreign Application Priority Data

Aug. 25, 2008 (DE) ..... 10 2008 039 454

(51) Int. Cl.

| | |
|---|---|
| ***B21B 19/04*** | (2006.01) |
| ***B21B 25/02*** | (2006.01) |
| ***B21C 45/00*** | (2006.01) |
| *B21B 17/04* | (2006.01) |
| *B21B 17/14* | (2006.01) |
| *B21B 23/00* | (2006.01) |

(52) U.S. Cl.

CPC ..... *B21B 25/02* (2013.01); *B21C 45/00* (2013.01); *B21B 17/04* (2013.01); *B21B 17/14* (2013.01); *B21B 19/04* (2013.01); *B21B 23/00* (2013.01)

USPC ..... 72/97; 72/209

(58) Field of Classification Search

USPC ..... 72/95–97, 208, 209, 367.1, 368, 72/370.01, 234

See application file for complete search history.

(56) References Cited

U.S. PATENT DOCUMENTS

| | | | | |
|---|---|---|---|---|
| 4,037,449 | A * | 7/1977 | Schuetz | 72/209 |
| 4,571,970 | A | 2/1986 | Moltner | |
| 7,469,565 | B2 | 12/2008 | Nakaike | |

(Continued)

FOREIGN PATENT DOCUMENTS

| | | |
|---|---|---|
| EP | 1764167 A | 3/2007 |
| GB | 2016338 A | 9/1979 |

(Continued)

OTHER PUBLICATIONS

Berg- und Huettenmaennische Monatsheft 130 1985, vol. 7, p. 205-211.

*Primary Examiner* — Shelley Self
*Assistant Examiner* — Matthew G Katcoff
(74) *Attorney, Agent, or Firm* — Andrew Wilford

(57) ABSTRACT

The invention relates to a method and a rolling mill for producing a seamless steel pipe in a continuous rolling process, where semi-finished material is first formed into a hollow block (8) in a rotary rolling mill, said block then being rolled in a multi-tooled continuous rolling mill (1) over a previously inserted mandrel (10) to form a tube blank (9), wherein the mandrel (10) receiving the hollow block and held by a mandrel holding and transporting device (5) disposed on the entry side is fed into the continuous rolling mill (1) and is transported back to the entry side after the tube blank has been rolled off of the mandrel (10) on an extracting rolling mill (4) connected downstream of the continuous rolling mill. An aim of the invention is to allow high production rates at the same product quality, particularly at a low drop in the temperature of the tube blanks. The aim is achieved in that the mandrel (10) with the tube blank (9) is released by the entry-side mandrel holding and transporting device (5) after exiting the last tool (**2.*n*) of the continuous rolling mill (1) and thus is transferred to an accompanying second mandrel holding and transporting device (6) connected downstream and held by the same until the tube blank (9) is rolled off by means of the extracting rolling mill (4**).

9 Claims, 1 Drawing Sheet

(56) References Cited

U.S. PATENT DOCUMENTS

| | | | | |
|---|---|---|---|---|
| 2002/0063145 | A1* | 5/2002 | Lotspaih et al. | 228/149 |
| 2008/0083254 | A1* | 4/2008 | Nakaike et al. | 72/97 |
| 2009/0044883 | A1* | 2/2009 | Prasser et al. | 148/593 |

FOREIGN PATENT DOCUMENTS

| | | | |
|---|---|---|---|
| JP | 04168221 | A | 6/1992 |
| WO | 03057383 | A | 7/2003 |
| WO | WO 2006045301 | A1 * | 5/2006 |

* cited by examiner

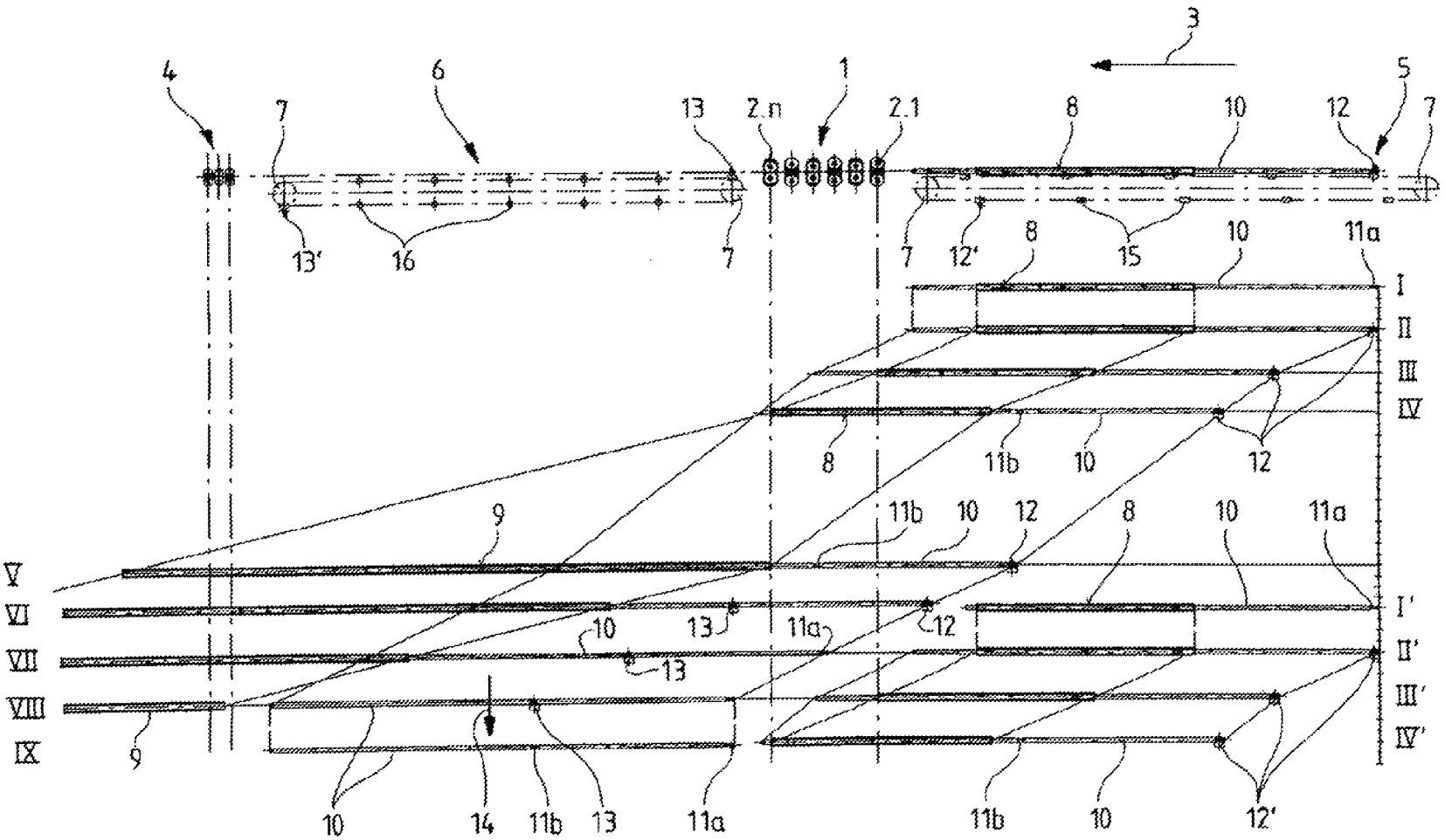
I
II
III
IV
I'
II'
III'
IV'
V
VI
VII
VIII
IX
1
2.1
2.n
3
4
5
6
7
8
9
10
11a
11b
12
12'
13
13'
14
15
16

METHOD OF AND ROLLING MILL FOR MAKING SEAMLESS STEEL PIPE

CROSS REFERENCE TO RELATED APPLICATIONS

This application is the US national phase of PCT application PCT/EP2009/005093, filed 14 Jul. 2009, published 11 Mar. 2010 as WO2010/025790, and claiming the priority of German patent application 102008039454.8 itself filed 25 Aug. 2008, whose entire disclosures are herewith incorporated by reference.

CROSS REFERENCE TO RELATED APPLICATIONS

This application is the US-national stage of PCT application PCT/EP2009/005093, filed 14 Jul. 2009, published 11 Mar. 2010 as WO2010/025790, and claiming the priority of German patent application 102008039454.8 itself filed 25 Aug. 2008.

FIELD OF THE INVENTION

The invention relates to a method of making a seamless steel pipe in a continuous rolling process where semifinished material is first formed in a rotary rolling mill into a hollow block that is then rolled in a multiple-stand continuous rolling mill over a previously inserted mandrel to form a tube blank, the mandrel receiving the hollow block and held by an upstream mandrel conveyor being fed into the continuous rolling mill and transported back upstream after the tube blank has been pulled off the mandrel by an extracting rolling mill downstream of the continuous rolling mill.

BACKGROUND OF THE INVENTION

Such a method and rolling mill for making seamless pipes by means of a continuous rolling method (continuous pipe rolling method) with a continuous rolling mill, also referred to as continuous pipe rolling mill, is known for example from *DE-Z Bergund Hüttenmännische Monatshefte* 130 (1985), Volume 7, pages 205-211. In most cases, rolled round steel bars are used as feed material, primarily in the form of continuous casting rounds with a diameter of up to 350 mm which are brought to rolling temperature in a rotary hearth furnace in lengths of up to 5 m. Subsequently, the piercing of the solid block to form a thin-walled hollow block takes place on a piercing mill which is normally constructed as a cross-roll piercing mill. The hollow block produced in this manner is then rolled in the same heat in the continuous rolling mill over a mandrel to form a tube blank. The continuous rolling mill consists mostly of six to nine rolling stands closely juxtaposed one behind the other, offset with respect to one another for example by 90°.

Before the start of the rolling process in the rolling mill, the hollow block including the mandrel inserted in it is moved in position by an upstream mandrel manipulator referred to in the industry as a conveyor, and is then pushed into the continuous rolling mill. There, the hollow block is gripped by the rolls and rolled out on the mandrel by the reduction rolls which become smaller from roll stand to roll stand. The mandrel is fed here by the mandrel conveyor during the rolling process with controlled, semicontrolled or fully controlled mandrel speed.

In the one case, the mandrel is released shortly before the end of rolling so that the mandrel and tube blank exit the rolling mill in the rolling direction and are transferred to a stripper where the mandrel is extracted. In the second case, in which the mandrel is fed during the entire rolling process with constant speed, the tube blank is pulled off the mandrel in an extracting rolling mill downstream of the continuous rolling mill. After this, the mandrel is returned back upstream. For these methods, and also for the methods known as free-floating method (free circulating mandrel), or semifloating method (mandrel restrained during rolling and afterward circulating), and restrained method (mandrel restrained during rolling, afterward pulled back), either a high production rate, if applicable combined with a short mandrel length (semifloating), but at the same time with an nonuniform tube blank temperature requiring a reheating of the tube blanks for subsequent processing can be implemented, or a uniform tube blank temperature, but with high cycle times due to the return transport and hence a low production rate can be implemented.

From DE 28 11 801 A1, a rolling mill with a multistand continuous rolling and a multistand extracting rolling mill is known in which a pipe to be rolled is rolled by a mandrel retained before the continuous rolling mill.

From DE 31 36 381 A1 and DE 142 79 15 A1, rolling mills are known that have one continuous rolling mill and one extracting rolling mill and that, between the continuous rolling mill and the extracting rolling mill, have a holding fixture for a mandrel conveyor.

OBJECT OF THE INVENTION

The object of the invention is to provide a method and a rolling mill of the described type by means of which the mentioned disadvantages can be avoided and high production rates at the same product quality can be achieved, in particular at a low temperature drop.

SUMMARY OF THE INVENTION

This object is attained with a method according to the invention in that the mandrel with the tube blank is released by the upstream mandrel conveyor after exiting the furthest downstream stand of the continuous rolling mill and is engaged downstream therefrom at the same time by a downstream mandrel conveyor and is held thereby until the tube blank is pulled off by the extracting rolling mill. This way, a semirestrained mandrel operating mode with continuous extraction of the mandrel by the extracting rolling mill arranged in line downstream of the continuous rolling mill is allowed, the continuous rolling mill and the upstream mandrel conveyor being already freely available during the downstream rolling for the simultaneous preparation of a subsequent rolling process. Thus, already during the further continuous extracting or rolling off in line, the following hollow block-mandrel assembly can be inserted.

The temperature drop of the rolling stock or the tube blanks is very small, which makes reheating unnecessary. The upstream cross-sections of the hollow block, which are increased according the invention, and a greater shaping in the continuous rolling mill contribute to this. By discharging the mandrel according to the invention between the continuous rolling mill and the extracting rolling mill, preferably orthogonally to the mandrel conveyor arranged there, or optionally in line through the extracting rolling mill, the extracting rolling mill can roll with a fixed roll pass, without quick-opening of the rolls, because the rolls do not need to be adjusted to the restrained mandrel's dimension and diameter which, with respect to the tube blank, are thicker and larger, respectively, in the thin-walled region. According to a proposal of the invention, during rolling, the mandrel is moved with restraining effect in a controlled manner in the continuous rolling mill in rolling direction and is continuously extracted in line upon entry into the extracting rolling mill.

Furthermore, the object is attained by a rolling mill in which a further mandrel conveyor is arranged in line between the continuous rolling mill and the extracting rolling mill.

Here, according to the invention the mandrel conveyor is equipped with two mandrel grippers spaced apart from each other, and the shafts of the mandrels are each equipped with two coupling heads, one of which is provided at the trailing end relative to the rolling direction, and the other one is provided downstream therefrom in the rolling direction. As soon as the coupling head, also referred to as the hinge, is released at the mandrel end from the upstream mandrel conveyor, the leading coupling head that is arranged further downstream is simultaneously engaged and held by the downstream mandrel conveyor arranged downstream until the tube blank is pulled off the mandrel by the extracting rolling mill. Thus, the two mandrel conveyors work together in such a manner that the leading coupling head is engaged as soon as the coupling head at the mandrel end is disengaged. The construction with two mandrel gripper or retaining units ensures that, after transferring the mandrel, the free mandrel gripper can take a home position for a subsequent rolling process as quickly as possible.

The mandrel conveyors are constructed as chains and are equipped with support bars.

According to an advantageous proposal of the invention, the support bars, at least of the downstream mandrel conveyor are formed as rollers. Thus, a speed difference between the chain and the tube blank can be compensated for.

BRIEF DESCRIPTION OF THE DRAWING

Further features and details of the invention are seen in the patent claims and the following description of an embodiment of the invention illustrated in a sole FIGURE.

DETAILED DESCRIPTION

From a rolling mill for making seamless steel pipes in a continuous rolling process, the very schematic FIGURE illustrates a continuous rolling mill 1 that here consists of a row of six roll stands 2.1 to **2.*n*, and an extracting rolling mill 4 downstream of it in a rolling direction 3, and a mandrel conveyor 5 upstream of the furthest upstream rolling stand 2.1, and a further, downstream mandrel conveyor 6 provided in line between the last roll stand 2.*n* of the continuous rolling mill 1 and the extracting rolling mill 4. The mandrel conveyors 5, 6 are constructed as chain holders guided around sprockets 7**.

For rolling an already made hollow block 8 in a rotary rolling mill (not shown) to form a tube blank 9, a mandrel 10 is inserted into the hollow block 8 as shown in flow diagrams I to IX of the chart at I, and this hollow block-mandrel assembly 8, 10 is moved to the upstream input end of the conveyor 5. There, the mandrel 10 which has a trailing coupling head **11*a* and, in addition, a leading coupling head 11*b* downstream therefrom in the rolling direction 3, is held by a mandrel gripper 12 of the upstream mandrel conveyor 5, as illustrated at the top of the FIGURE and shown at II. The mandrel 10 with the surrounding hollow block 8 is held by the gripper 12 and is subsequently transported as shown at III downstream to the furthest upstream roll stand 2.1 of the continuous rolling mill 1. There, the hollow block 8 is picked up by the rolls of the furthest upstream roll stand 2.1 and is then rolled out by the following stands to stand 2.*n* (see IV) to form the tube blank 9. For this purpose, the mandrel 10 of the upstream mandrel conveyor 5 is continuously moved with a specifically controlled speed in the rolling direction 3**.

As soon as the tube blank 9 has left the furthest downstream roll stand **2.*n* of the continuous rolling mill 1 (see V), and the mandrel with its leading coupling head 11*b* has reached the region of the downstream mandrel conveyor 6, the trailing coupling head 11*a* of the mandrel 10 is uncoupled from the gripper 12 of the upstream mandrel conveyor 5 and, at the same time, the leading coupling head 11*b* is engaged by a mandrel gripper 13 of the downstream mandrel conveyor 6** (see positions VI and VII).

The mandrel 10 is held by the gripper 13 until the tube blank 9 is pulled off the mandrel 10 by the extracting rolling mill 4 (see pos. VIII). As soon as the mandrel 10 is released from the tube blank 9, it is shifted laterally or orthogonally as shown by arrow 14 and is available in the mandrel cycle for a new rolling process. Here, as illustrated at I' to IV', the insertion of the mandrel 10 into a hollow block 8 for a subsequent rolling with positioning of the hollow block mandrel assembly 8, 10 can be carried out at a point in time when the tube blank 9 of the previous rolling process is still being pulled off the mandrel 10. In order that after transfer of the mandrel 10 the home position for a subsequent rolling can be reached again as quickly as possible, the mandrel conveyors 5, 6 are equipped with an upstream mandrel gripper 12' or 13'.

The upstream mandrel conveyor 5 is provided with support bars 15, whereas the chains of the mandrel conveyors between the continuous rolling mill 1 and the extracting rolling mill 4 are equipped with rollers 16 to compensate for the speed difference between their chains and the tube blank 9.

The invention claimed is:

1. A method of making a seamless steel pipe from a hollow block, the method comprising the steps of sequentially:

engaging a mandrel through the block;

gripping the mandrel relative to a rolling direction upstream of the block with an upstream gripper and displacing the mandrel and the block downstream by the upstream gripper in the rolling direction through a multiple-stand continuous rolling mill so as to convert the hollow block into a tube blank until the tube blank exits the continuous rolling mill in the rolling direction, all while still gripping the upstream end by the upstream gripper upstream of the continuous rolling mill;

gripping the mandrel downstream of the continuous rolling mill and upstream of the tube blank with a downstream gripper;

with the upstream gripper upstream of the continuous rolling mill, releasing the mandrel from the upstream gripper and displacing the mandrel and tube blank downstream to an extracting mill by the downstream gripper;

pulling the tube blank off the mandrel with the extracting mill while holding the mandrel against synchronous downstream movement with the tube blank by the downstream gripper downstream of the continuous rolling mill; and transporting the mandrel back upstream for engagement through another hollow block.

2. The method defined in claim 1, further comprising the step, during rolling in the continuous rolling mill, of:

moving the mandrel in a controlled manner in the rolling direction.

3. The method defined in claim 1, further comprising the step, after pulling the tube blank off the mandrel with the extracting mill, discharging the mandrel orthogonally to the rolling direction from the downstream mandrel gripper.

4. The method defined in claim 1, wherein the grippers are spaced in the rolling direction from one another, and that the mandrels are shafts equipped with two coupling heads, one of which is provided at the trailing end, viewed in the rolling direction, and the other one is provided spaced downstream therefrom in the rolling direction.

5. The method defined in claim 1, wherein the grippers are constructed as chains and are equipped with support bars.

6. The method defined in claim 5, wherein the support bars of at least the downstream gripper are equipped with rollers.

7. The method defined in claim 1, further comprising the step after the mandrel is released from the upstream gripper, the upstream gripper is upstream of the continuous rolling mill.

8. The method defined in claim 1, wherein, after releasing the mandrel from the upstream gripper, the mandrel is pulled completely by the downstream gripper through the continuous rolling mill.

9. The method defined in claim 1 wherein the upstream gripper is at all times during execution of the method upstream of the continuous rolling mill and the downstream gripper is at all times during execution of the method downstream of the continuous rolling mill.

* * * * *